United States Patent [19]

McFarlane et al.

[11] Patent Number: 4,761,857

[45] Date of Patent: Aug. 9, 1988

[54] METHOD AND APPARATUS FOR MAKING LONG-TAILED NEPS

[75] Inventors: Ian D. McFarlane, Christchurch; Melvin Jones, Canterbury; Mark Watson, Christchurch; Richard J. Walls, Christchurch; Leslie T. Clare, Christchurch; Edward C. Radford, Christchurch, all of New Zealand

[73] Assignee: Wool Research Organisation of New Zealand Inc., Canterbury, New Zealand

[21] Appl. No.: 940,244

[22] Filed: Dec. 10, 1986

[30] Foreign Application Priority Data

Dec. 13, 1985 [NZ] New Zealand ..... 214555
Aug. 5, 1986 [NZ] New Zealand ..... 217094

[51] Int. Cl.[4] ..... D01C 15/40
[52] U.S. Cl. ..... 19/98; 19/106 R
[58] Field of Search ..... 19/98, 99, 106 R, 80 R, 19/81

[56] References Cited

U.S. PATENT DOCUMENTS

| | | | |
|---|---|---|---|
| 1,470,827 | 10/1923 | Godfrey | 19/106 R |
| 2,388,030 | 10/1945 | Beaudoin | 19/106 R |
| 2,703,439 | 3/1955 | Dole et al. | 19/106 R |
| 2,992,458 | 7/1961 | Witschi | 19/106 R |
| 4,494,204 | 1/1985 | Hösel | 19/106 R |

*Primary Examiner*—Louis K. Rimrodt
*Attorney, Agent, or Firm*—Watson, Cole, Grindle & Watson

[57] ABSTRACT

A method and mechanism for manufacturing long-tailed neps useful as a fill or effect material the method including feeding a synthetic or natural fibrous material to a woollen opening mechanism with its outlet closed, running the opening mechanism for a predetermined period, opening the outlet of the opening mechanism so that a rotating fan doffer roller of the opening mechanism throws therefrom a plurality of modified fibre neps, each of which has a nep-shaped region from the fibres of which extends a tail (long-tailed neps). The fibrous material can be scoured wool, a synthetic fibrous material or woollen fibres in an unclean state with vegetable matter and other contaminants entrained therewith. The mechanism includes a housing having a closable inlet and a closable outlet, the housing forming a chamber in which a rotating roller member is mounted, the rotating roller member having on its periphery a plurality of teeth which co-operate with teeth located in the chamber, the mechanism operating on the fibrous material fed through the inlet to spin it in the closed chamber for a predetermined period and by the interaction of the teeth, form it into a plurality of long-tailed neps.

15 Claims, 2 Drawing Sheets

METHOD AND APPARATUS FOR MAKING LONG-TAILED NEPS

BACKGROUND OF THE INVENTION

1. Field Of The Invention

The invention relates to a process for producing a fill material or effect fibre and a fill or effect fibre material produced thereby which can be used in bedding products or to product effect yarns.

2. The Prior Art

A number of materials are currently used as fill materials in duvets, eiderdowns, jackets, sleeping bags and other such items. The fill material is chosen for its light weight, fill ability and insulating properties. Known materials used in these situations include synthetic fills, e.g., dacron, carded wool and down. However, these known fill materials suffer from inherent disadvantages. For example, carded, because of the linear orientation of its fibres, suffers in use from fibre disentanglement thereby, resulting in a loss in bulk.

At present, existing knops or neps produced from woollen fibres are used to create effect yarns and the knops or neps are produced in a number of ways. Each knop is a small ball of entangled fibres, i.e., fibres which are wrapped and/or felted on themselves. A problem with existing knops or neps in effect fibres is that there is a lack of entanglement between the fibres of the knop or nep and the fibres of the yarn with which they are entrained. This can result in the knops or neps falling off or away from the yarn or effect material.

An object of the present invention is to provide a process for producing a fill material or effect fibre material and a fill or effect material produced thereby.

A further object of the present invention is to provide an effect material usable in the preparation of synthetic and natural effect yarns, for example, in woollen or semi-worsted processing.

Yet a further object of the invention is to provide a process for handling wool and wool textiles in a rapid and efficient manner which results in the removal of vegetable matter and other contaminants from the wool and wool textiles.

SUMMARY OF THE INVENTION

According to a first aspect of the present invention there is provided a method of manufacturing long-tailed neps useful as a fill or effect material, the method including feeding a synthetic or natural fibrous material to a woollen opening mechanism with its outlet closed, running the opening mechanism for a predetermined period, opening the outlet from the opening mechanism so that the rotating opening mechanism throws therefrom a plurality of modified neps, each of which has a nep-shaped region from which extends a tail of fibres. These modified neps are hereinafter referred to as long-tailed neps.

The fibrous material can be scoured wool, a synthetic fibrous material or woollen fibres in an unclean state with vegetable matter and other contaminants entrained therewith.

The method can in addition include spraying water into a fan doffer region of the opening mechanism. The amount of water sprayed can be varied to alter the characteristics of the long-tailed neps produced.

The method can also include adding water to a woollen fibrous material prior to its insertion into the opening mechanism.

According to a second aspect of the present invention there is provided a mechanism for manufacturing a fill or effect material, the mechanism including a means for feeding a synthetic or natural fibrous material to a housing having a closable inlet and a closable outlet, the housing forming a chamber in which a rotating member is mounted, the rotating member having on its periphery a plurality of teeth which co-operate with teeth on the inner periphery of the chamber, the mechanism operating such that a synthetic or natural fibrous material fed through the inlet and allowed to spin in the closed chamber for a predetermined period is formed by the interaction of the teeth into a plurality of modified neps, each of which has a nep-shaped region from which extends a tail of fibres.

The housing preferably includes a fan doffer type roller alongside the rotating member, the doffer type roller rotating at a higher speed than the rotating member and being adapted to beat from the teeth on the rotating member the partly processed material and feed same toward the outlet. The rotating member can rotate at a speed of about 200 rpm while the doffer roller can rotate at not less than 500 rpm.

The housing can be a woollen opening mechanism in which the relationship between the standard worker stripper rollers and the swift can be reversed.

The long-tailed neps, if produced from scoured wool or synthetic fibrous material, can be used as a fill or effect material. The long-tailed neps, if produced from unclean wool and wool textiles, is in a cleansed state usable in a variety of further wool processing steps.

An electronic control system can be used to regulate the time the door of the opening mechanism is closed, the time of spraying of the water into the fan doffer region, the rate of feed of the input material, and the time the outlet of the machine is held open, and is an essential feature of adaption of the mechanism for industrial use.

If a standard woollen opening mechanism is used, it can have one or more of its stripper and worker rollers removed or modified prior to the mechanism being used to produce the long tailed neps.

According to an alternative aspect of the invention, there is provided a process for treating long-tailed neps, the process including treating the long-tailed neps in a solvent scouring process, including tumbling the long-tailed neps in a solvent scouring machine to increase the entanglement of the peripheral fibres with each other to reduce the tendency of the dried long-tailed neps to form clumps. The product produced by this process is referred to hereinafter as soft knops.

The solvent scouring can include the use of any dry cleaning solvent which has added thereto treating chemicals giving particular additional properties to be added to the properties of the soft knops. The additive can include a silicon treatment.

DETAILED DESCRIPTION OF THE INVENTION

Figure 4:
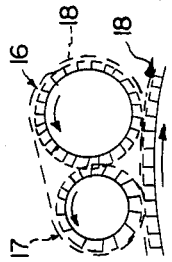
FIG. 4 is the worker and stripper rollers of FIG. 3 in a modified form usable according to the present invention.

The invention utilizes as an input product either a synthetic or natural fibrous material and the example will be described with reference to the use of a scoured fleece or alternatively a mixture of waste from other wool treatment processes. The fibre orientation of the input product is not important.

In FIGS. 1 to 4 an existing woollen opening machine 1 is utilized. A woollen opening machine is normally used to open or increase the bulk of woollen fibres.

In normal use the opening machine 1 has the input material 2 fed onto feeding aprons 3 via a feed hopper 4. The feed hopper has an input feeder 5 which fills the feed hopper 4. The feeder 5 can be an elevator 6 and feed roller 7 adapted to convey input material 2 to the hopper 4. The woollen opening machine 1 has a drum-shaped housing 8 within which is mounted a drum or swift 9 on the periphery of which there is a random array of teeth 10 which catch the wool from a set of feed rollers 11 to which the fibres are directed by the feeding aprons 3. Normally the input material 2 is carried through the housing past stripper and worker rollers 12 (shown in conventional form in FIG. 3). The teeth on the rollers 12 remove some of the fibres from the teeth 10 as they rotate. The opened fibres are beaten from the swift 9 by a fan doffer roller 14 located in an extension portion 15 of the housing 8 and are blown or dumped from an outlet 13 in the extension portion 15.

A door 30 which is pivotally attached to the extension portion 15 is movable by means 31 to cover or uncover the outlet 13. In the past the woollen material has been removed for further processing and is in an opened condition relative to its initial compressed form so as to be suitable for the next processing step.

Figure 3:
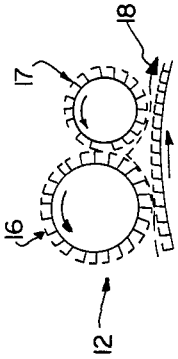
FIG. 3 is an unmodified worker and stripper rollers of the type incorporated in a conventional woollen opening mechanism.
Figure 2:
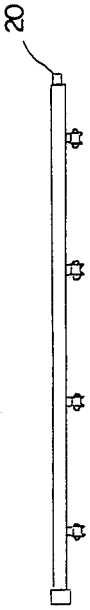
FIG. 2 is an example of spray boom adapted to fit in the opening mechanism shown in FIG. 1.

As shown in FIG. 4 the opener is modified and the worker and stripper rollers 16 and 17 respectively of the conventional construction (as shown in FIG. 3) are reversed in position so that the path of the material 18 is in part changed as indicated in the different yarn paths shown in FIGS. 3 and 4. One of the sets of worker stripper rollers 12' is shown removed from the mechanism.

When modified in accordance with the present invention, the outlet 13 is preferably positioned relative to a collector cage 19. The means 31 can be a pneumatic piston-cylinder device and it can move the door 30 such that the flow of material is in the direction of the arrows shown. The direction of flow and direction of rotation of the respective rollers are shown in the drawings. The fan doffer roller extension 15 of the housing 8 can have mounted therein a spray boom 20 (shown in FIG. 2) connected to a supply of water to dampen the material being spun in the housing 8.

Figure 1:
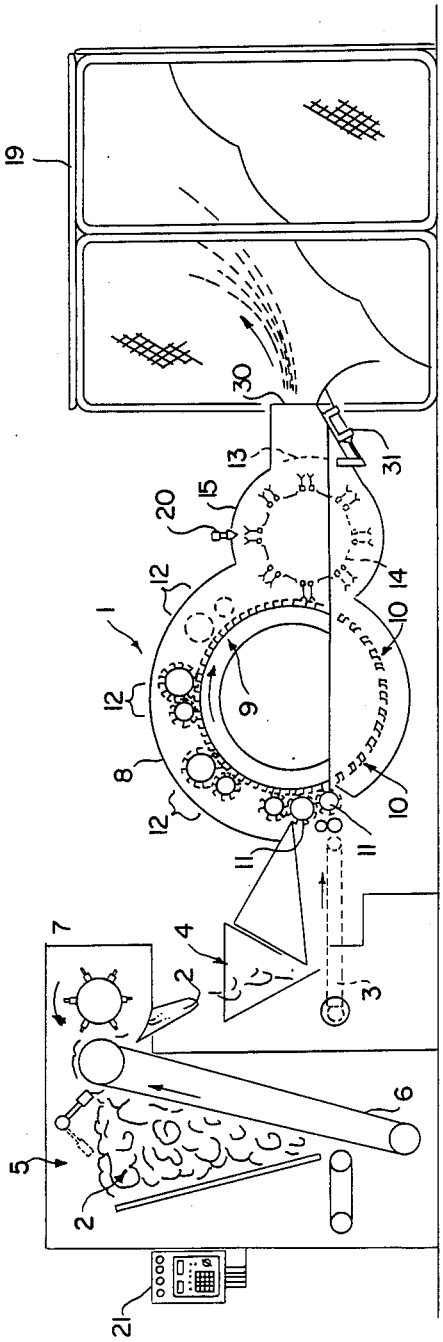
FIG. 1 is a schematic section through a woollen opening mechanism modified in accordance with the present invention.
Figure 5:
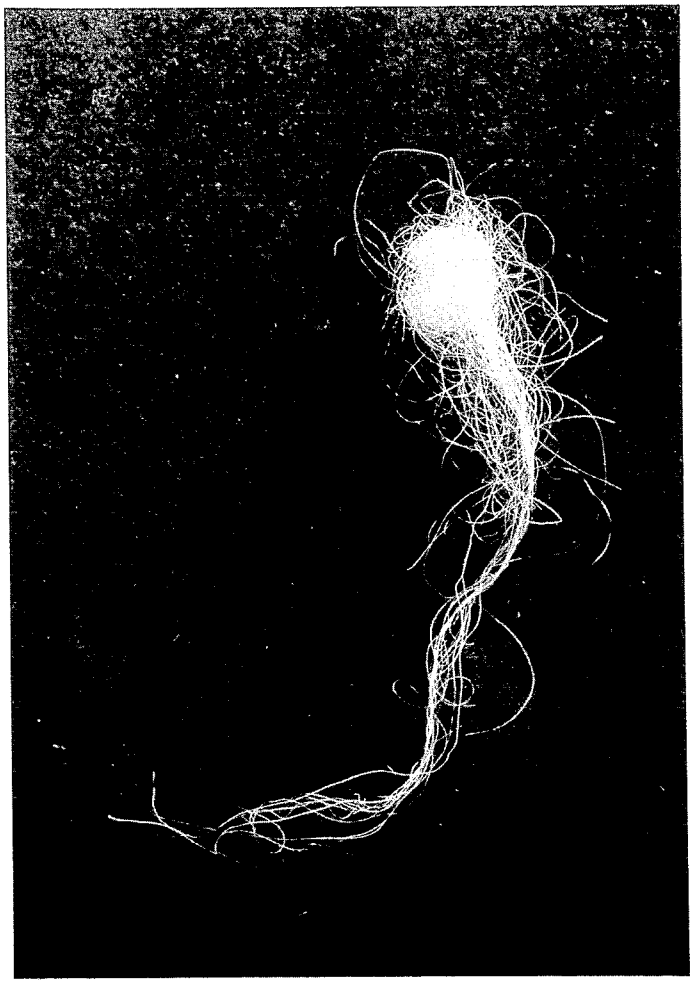
FIG. 5 is on an enlarged scale, a photograph of a typical long tailed nep.

The applicants have discovered that by feeding the input material 2 to such a modified opening machine as shown in FIG. 1 with its normal outlet 13 closed, running the opener for a preselected time controlled by a timer in a controller 21 there is produced an end product which has a fibre orientation which lends itself for a variety of uses, for example as a fill or effect material. The preselected time can depend on the input material. The applicants have discovered that, with modifications to the stripper and worker rollers 16, 17 as shown in Figure 4 and with the doffer or fancy roller 14 retained in the housing 8, a proportion of the wool is beaten from the teeth 10 by the beaters of the doffer roller to be spun at high speed within the housing 8 or extension 15 until the outlet 13 is opened. The fibres of the output material are randomly wrapped on themselves to produce a plurality of nep-like products, from each of which a tail extends with a high degree of entanglement between the nep-shaped part and its tail. Such an end product is herein referred to as a long-tailed nep. A typical example of a long-tailed nep is shown in FIG. 5. In the drawing the long tailed nep is shown enlarged to about twice its normal size.

The applicants' trials have indicated that the long-tailed neps maintain their fibre orientation and are therefore useful as a substitute fill material or effect material.

The controller 21 preferably includes an infinitely variable automatic sequence controller for a single or double spray cycle usable to produce batch loads of soft knops. A typical operating sequence includes the following steps:

(0) Delay Start (1) Feed Time (2) Hold For 1st Spray (3) Spray Time (4) Hold For 2nd Spray (5) Spray Time (6) Hold Empty Time (7) Empty Time (8) Delay Close Trap.

For single spray cycle the controller can jump steps 3 to 6.

A minor problem with the use of a long-tailed neps formed by the process described hereinbefore is that, in use, the long-tailed neps have a tendency to clump together, thus reducing in part their effectiveness as a fill or insulation material. This is caused by interfibre entanglement between the loose or free fibres on the periphery of the long-tailed neps.

In order to ameliorate this problem the long-tailed neps as produced can be immersed in a dry cleaning solvent in a dry cleaning machine. The drum of the dry cleaning machine is rotated, thereby tumbling the neps while immersed in the solvent. The neps are then spun dry and dried whilst being continually tumbled.

The applicants have discovered that the treated long-tailed neps, when dry, have their peripheral hairs folded into the central felted region of the nep. The surface of the treated neps therefore has few if any free fibre ends which can link with other free fibres to cause clumping of the treated long tailed neps.

The size of the treated long-tailed neps is dependent on the initial fibre length and diameter and the products are referred to herein as soft knops. A variety of sizes can be produced to suit particular use requirements.

In certain circumstances the dry cleaning solvent can have added thereto additives, for example, a silicon additive to produce in the final product particular properties. For example, a silicon treatment produces a more slippery product which moves readily relative to each other when incorporated in a finished product.

Preferably the input material fed into the opening machine is dampened as this can improve the wrapping entanglement of the fibres forming the product while it is formed in the opening machine. The applicants' trials have shown that if the material is allowed to be spun in the opening machine for at least 20 seconds and typically 60 seconds an acceptable end product is produced.

Alternatively, a modified wool dag crushing machine can be used or a machine can be purpose built specifically to make the long-tailed neps. Such a machine would need to have a fan doffer roller or similar device capable of revolving at in excess of 500 rpm. Facility to fully enclose the device for a predetermined period is also necessary.

Thus by this invention there is provided a process for producing a fill or effect woollen material which retains its bulk and fibre orientation during normal use conditions.

Particular examples of the invention have been described herein by way of example and it is envisaged that improvements and modifications can take place without departing from the scope and spirit of the appended claims.

What we do claim and desire to obtain by Letters Patent of the United States is:

1. In an apparatus for manufacturing long-tailed neps useful as a fill or effect material, said apparatus including a housing which defines a treatment chamber therein and provides an inlet opening and an outlet opening, a drum which is rotatably positioned in said treatment chamber, said drum including outwardly-extending teeth, cooperating teeth located in said treatment chamber and extending toward and cooperable with the outwardly-extending teeth of said drum such that they will cause fibrous material carried on the outwardly-extending teeth of said drum to become entangled, a fan doffer roller rotatably positioned in said chamber between said drum and said outlet opening so as to remove entangled fibrous material from the outwardly-extending teeth of said drum and sling it towards said outlet opening, and a feed means for supplying fibrous material to said treatment chamber via said inlet opening of said housing, the improvement wherein said apparatus includes a door which is movable to cover or uncover said outlet opening, said door being moved to cover said outlet opening when said drum and said fan doffer roller are rotating and fibrous material in said treatment chamber is being entangled therein such that said fibrous material will remain in said treatment chamber sufficiently long to be converted into said long-tailed neps.

2. An apparatus as defined in claim 1, wherein said cooperating teeth are mounted on pairs of closely positioned worker and stripper rollers which are rotatably positioned around the periphery of said drum in said treatment chamber.

3. An apparatus as defined in claim 2, wherein said stripper rollers of each pair of worker and stripper rollers are located closer to said inlet opening than the worker rollers of each pair.

4. An apparatus as defined in claim 1, wherein said housing provides a drum-shaped portion in which said drum is rotatably positioned and an extension portion in which said fan doffer roller is rotatably positioned.

5. An apparatus as defined in claim 4, wherein said outlet opening is in said extension portion, and said door is pivotally connected to said extension portion.

6. An apparatus as defined in claim 4, including a liquid sprayer means positioned in said extension portion to spray liquid on the long-tailed neps therein.

7. An apparatus as defined in claim 1, including a controller for automatically controlling the operation of said feed means and the movement of said door.

8. A method of converting fibrous material into long-tailed neps useful as a fill or effect material using a woollen opening mechanism which includes a housing which defines a treatment chamber therein and provides having an inlet opening and an outlet opening, a drum having outwardly-extending teeth positioned in said treatment chamber, cooperating teeth positioned in said treatment chamber adjacent the outwardly-extending teeth of said drum, and a fan doffer roller positioned in said treatment chamber between said drum and said outlet opening, said method comprising the steps of (a) supplying a fibrous material to said treatment chamber via said inlet opening, (b) covering said inlet and outlet openings, (c) rotating said drum and said fan doffer roller so that the fibrous material will become entangled and randomly wrapped within said treatment chamber, thereby forming long-tailed neps, and (d) uncovering said outlet opening so that said fan doffer roller will sling said long-tailed neps therethrough and out of said treatment chamber.

9. A method as defined in claim 8, including the step of spraying liquid into the fibrous material being treated in said treatment chamber.

10. A method as defined in claim 8, including the step of pre-wetting the fibrous material supplied to the treatment chamber in step (a).

11. A method as defined in claim 8, wherein the fibrous material supplied to the treatment chamber in step (a) is scoured wool, synthetic fibrous material, or unclean woollen fibrous material.

12. A method as defined in claim 8, wherein in step (c) said drum is rotated at about 200 rpm and said fan doffer roller is rotated at at least 500 rpm.

13. A method as defined in claim 8, wherein step (c) is conducted for at least 20 seconds.

14. A method as defined in claim 8, including after step (d) the step of (e) tumbling said long-tailed neps with a scouring solvent in a solvent scouring machine to increase the entanglement of the fibres in said long-tailed neps and reduce their tendency to form clumps when dried.

15. A method as defined in claim 14, wherein in step (e) said long-tailed neps are tumbled with a dry cleaning solvent and a silicon treating agent in said solvent scouring machine.

* * * * *